US006938444B2

(12) United States Patent
Hong et al.

(10) Patent No.: US 6,938,444 B2
(45) Date of Patent: Sep. 6, 2005

(54) DEVICE FOR LINKING DOOR TO CASE IN DRUM TYPE WASHING MACHINE AND METHOD FOR ASSEMBLING THE SAME

(75) Inventors: Kyung Seop Hong, Inchon-kwangyokshi (KR); Jun Woo Kim, Kwangmyong-shi (KR)

(73) Assignee: LG Electronics Inc., Seoul (KR)

( * ) Notice: Subject to any disclaimer, the term of this patent is extended or adjusted under 35 U.S.C. 154(b) by 355 days.

(21) Appl. No.: 10/218,623

(22) Filed: Aug. 15, 2002

(65) Prior Publication Data

US 2003/0172692 A1 Sep. 18, 2003

(30) Foreign Application Priority Data

Mar. 13, 2002 (KR) ..... P2002-13598

(51) Int. Cl.[7] ..... D06F 39/14

(52) U.S. Cl. ..... 68/196; 134/200; 134/3 R; 16/366; 16/371

(58) Field of Search ..... 68/3 R, 196; 134/200; 16/319, 346, 365, 366, 368, 371

(56) References Cited

U.S. PATENT DOCUMENTS 1,331,556 A * 2/1920 Blood ..... 217/60 E
2,300,989 A * 11/1942 Stoddard et al. ..... 16/245
2,708,293 A * 5/1955 Sherman ..... 49/382
2,757,663 A * 8/1956 Pearce ..... 126/194
2,892,209 A * 6/1959 Condit ..... 16/321
2,901,766 A * 9/1959 Marquis ..... 16/370
3,378,880 A * 4/1968 Haldopoulos et al. ..... 16/337
3,521,319 A * 7/1970 Fisher ..... 16/332
3,653,092 A * 4/1972 Shriner ..... 16/268
3,921,252 A * 11/1975 Guth ..... 16/281
4,319,382 A * 3/1982 Zernig ..... 16/251
4,389,748 A * 6/1983 Grossman ..... 16/278
4,665,892 A * 5/1987 Spargo et al. ..... 126/194
4,817,240 A * 4/1989 Sovis et al. ..... 16/297
4,843,680 A * 7/1989 Cress et al. ..... 16/289
5,025,776 A * 6/1991 Hanley et al. ..... 126/194
5,274,954 A * 1/1994 Quarfordt et al. ..... 49/386
5,341,542 A * 8/1994 Hannan et al. ..... 16/289
5,937,481 A * 8/1999 Faringosi ..... 16/332
5,946,774 A * 9/1999 Ramsey et al. ..... 16/357
6,789,293 B2 * 9/2004 Habegger et al. ..... 16/343

* cited by examiner

*Primary Examiner*—Frankie L. Stinson
(74) *Attorney, Agent, or Firm*—Fleshner & Kim, LLP

(57) ABSTRACT

Device for linking a door to a case in a drum type washing machine including a bracket having one end to be inserted in a pass through hole formed in the vicinity of the laundry opening in a washing machine case, and the other end fixed to an outside wall of the case, and a foldable link member having a first link rotatably fitted to the one end of the bracket, a second link exposed to an outside through the pass through hole and rotatably fitted to the door, and a hinge connecting the first link and the second link, thereby permitting an easy assembly, and improving convenience of a user.

8 Claims, 13 Drawing Sheets

DEVICE FOR LINKING DOOR TO CASE IN DRUM TYPE WASHING MACHINE AND METHOD FOR ASSEMBLING THE SAME

This application claims the benefit of the Korean Application No. P2002-013598 filed on Mar. 13, 2002, which is hereby incorporated by reference.

BACKGROUND OF THE INVENTION

1. Field of the Invention

The present invention relates to a drum type washing machine, and more particularly, to a device for linking a door to a case in a drum type washing machine, and a method for assembling the same.

2. Background of the Related Art

In general, the washing machine is an appliance for removing dirt stuck to laundry by chemical decomposition and mechanical impact.

Of washing machines, it is recent trend that demands for the drum type washing machine increases gradually, because the drum type washing machine, not only can reduce a total height compared to a pulsator type washing machine in which an inner tub, a washing tub, rotates in an upright position, but also increases a washing capacity, and causes no problem of laundry entangling.

System and operation of a related art drum type washing machine will be explained, with reference to FIG. 1A.

The related art drum type washing machine is provided with a case 1 having a laundry opening 1*a* in a front surface, an outer tub 2 supported in the case by a damper 5 and springs 6, an inner tub 3 rotatably fitted in the outer tub, and a driving part 4 for rotating the inner tub 4. The unexplained reference symbol 2*a* denotes a gasket, and 7 denotes a door. The drum type washing machine washes laundry following a washing cycle-rinsing cycle-spinning cycle progressed in a sequence.

A related art device for linking a door to a case in a drum type washing machine will be explained with reference to FIGS. 1B and 2.

The case 1 is provided with a pass through hole 1*b* and a coupling hole (not shown) for linking the door. The device for linking a door to a case is provided with a support 8 on an inside surface of the case 1 in the vicinity of the laundry opening 1*a*, and a rotating arm 9 of a double arc having one end rotatably fitted to the support, and the other end exposed to an outside through the pass through hole 1*b* in the case, and rotatably fitted to the door.

The related art device for linking a door to a case links the door to the case according to the following assembly method.

At first, one end of the rotating arm 9 is rotatably fitted to one end of the support 8. Then, the support 8 and the rotating arm 9 are brought to an inside of the case 1, the other end of the rotating arm 9 is passed through the pass through hole 1*b*, to expose the other end of the rotating arm 9 to an outside, and the other end of the support 8 is brought to a coupling hole (not shown) in the case. Then, the case 1 and the support 8 are fastened with a screw 8*a*. The screw 8*a* is fastened from an outside of the case 1 to an inside of the case 1, in an order of the fastening hole in the case 1 and the fastening hole 8*b* in the other end of the support 8. Finally, the other end of the rotating arm 9 is rotatably fitted to the door 7.

Thus, upon finishing assembly, the laundry opening 1*a* can be opened/closed as the door 7 is rotated by the link device as shown in FIGS. 3A and 3B.

However, the related art device for linking a door to a case has the following problems.

First, the screw fastening of the support 8 and the rotating arm 9 brought to an inside of the case 1 from the outside of the case takes much time for exact positioning of the support 8 inside of the case 1, to require a support fixing jig (not shown) inside of the case 1 additionally, that increases a production cost, and an assembly time period of the link device.

Second, position change of the link device is actually impossible after assembly of the drum type washing machine is finished. That is, for changing a rotation direction of the door suitable for a right handed user or a left handed user, it is required that a fitting position of the link device is changed to a left side or to a right side. In general, the fitting position change of a link device requires detachment/attachment of a gasket 2*a*. However, detachment of the gasket 2*a* is actually not possible since the gasket 2*a* is a member for preventing leakage between the case 1 and the outer tub 2.

SUMMARY OF THE INVENTION

Accordingly, the present invention is directed to a device for linking a door to a case in a drum type washing machine, and a method for assembling the same that substantially obviates one or more of the problems due to limitations and disadvantages of the related art.

An object of the present invention designed for solving the foregoing problems is to provide a device for linking a door to a case in a drum type washing machine, assembly of which is easy, and a fitting position change of which is easy depending on a left handed or right handed user.

Another object of the present invention is to provide a method for assembling the device for linking a door to a case.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for linking a door to a case in a drum type washing machine including a bracket having one end to be inserted in a pass through hole formed in the vicinity of the laundry opening in a washing machine case, and the other end fixed to an outside wall of the case, and a foldable link member having a first link rotatably fitted to the one end of the bracket, a second link exposed to an outside through the pass through hole and rotatably fitted to the door, and a hinge connecting the first link and the second link, thereby fitting the link member and the bracket to be detachable from an outside of the washing machine on the same time by inserting the link member in an unfolded state, together with the bracket through the pass through hole.

Preferably, the hinge of the link member further includes a stopper, and the stopper includes a projection from the first link in the vicinity of the hinge, and a recess in the second link of the link member.

Preferably, the bracket further includes a flange so that the other end of the bracket is caught at the outside wall of the case, and a fastening part to the case is secured. More preferably, for screw fastening of the flange with the case, the flange and the case have fastening holes in communication to each other.

The second link of the link member preferably includes an arc form, for smooth movement of the second link of the link member through the pass through hole when the first link of the link member rotates.

The hinge preferably has a friction force Fh greater than a rotating friction force Fb between the first link of the link member and the one end of the bracket, and greater than a rotating friction force Fd between the second link of the link member and the door. The rotating friction force Fd between the second link of the link member and the door is preferably greater than rotating friction force Fb between the first link of the link member and the one end of the bracket.

In another aspect of the present invention, there is provided a method for assembling a device for linking a door to a case in a drum type washing machine, the device including a bracket having one end to be inserted in a pass through hole formed in a washing machine case, and the other end fixed to the case, and a link member having a first link rotatably fitted to the one end of the bracket, a second link rotatably fitted to the door, and a hinge connecting the first link and the second link, the method including the steps of (a) rotatably fitting the first link of the link member to the one end of the bracket, (b) unfolding the first link and the second link of the link member, and rotating the bracket until the bracket overlaps with the unfolded link member, (c) inserting the first link of the link member and the one end of the bracket through the pass through hole, and fixing the other end of the bracket to an outside wall of the case, (d) folding the link member such that the second link has a rotation radius around the first link of the link member, and (e) rotatably fitting the second link of the link member to the door.

The other end of the bracket is fixed to an outside wall of the case.

Thus, the foregoing device for linking a door to a case in a drum type washing machine, and a method for assembling the same permits an easy assembly of the door and an easy fitting position change of the door according to a left handed or right handed user.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1A:
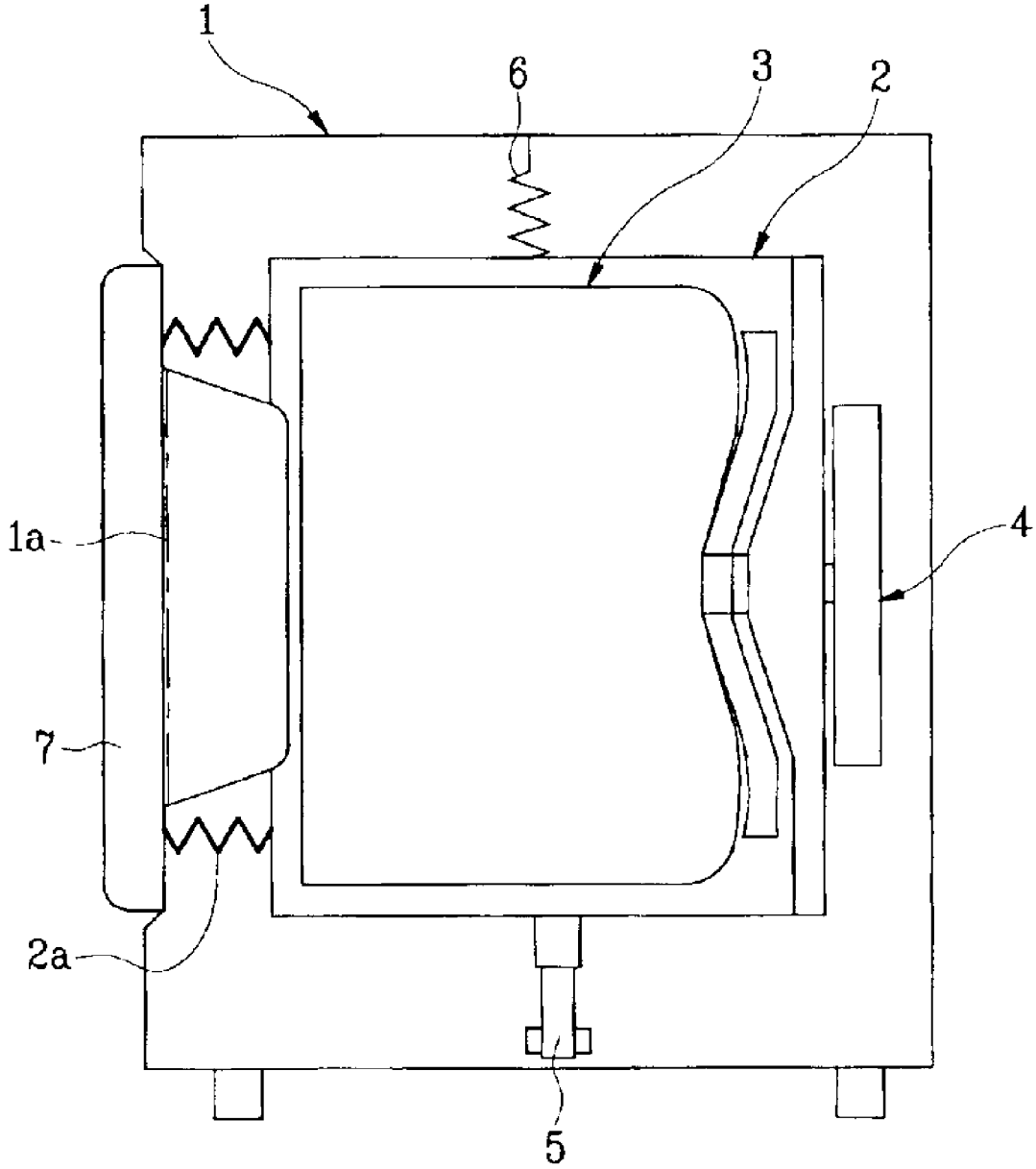
FIG. 1A illustrates a section of a related art drum type washing machine.
Figure 1B:
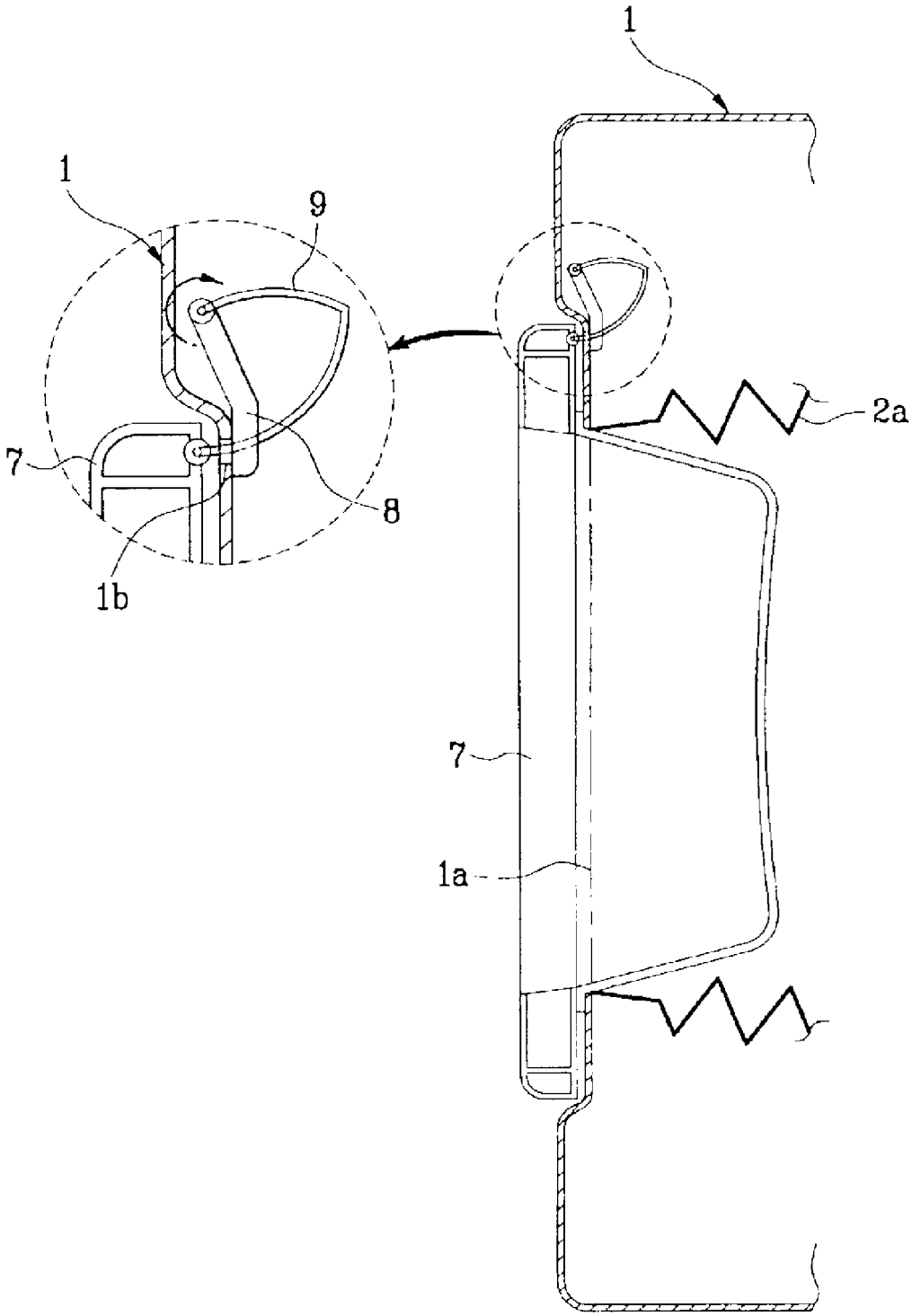
FIG. 1B illustrates a partial enlarged section of FIG. 1A showing a related art device for linking a door to a case in a drum type washing machine.
Figure 2:
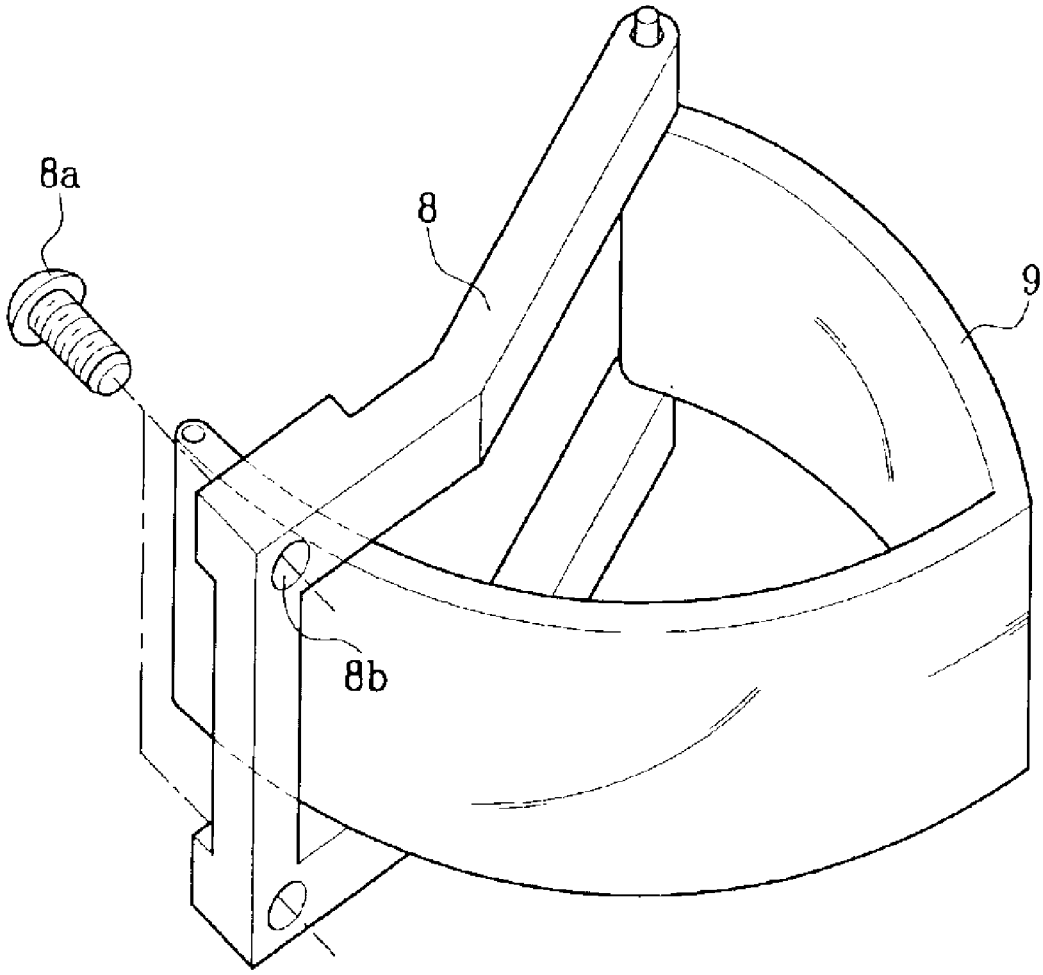
FIG. 2 illustrates a perspective view showing the device for linking a door to a case in FIG. 1B in detail.
Figure 3A:
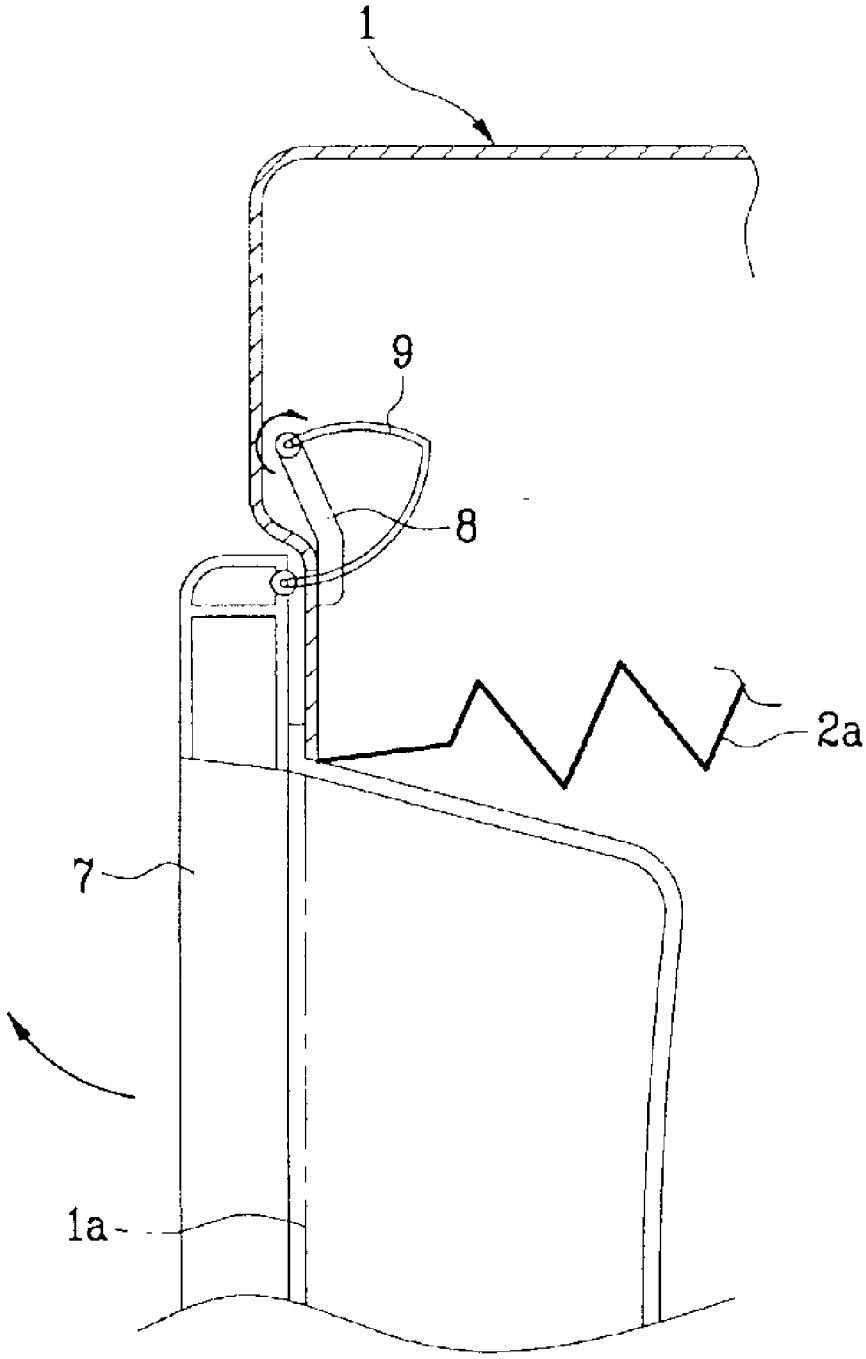
FIGS. 3A and 3B illustrate an opening process of a laundry opening by rotating a door using a related art link device.
Figure 3B:
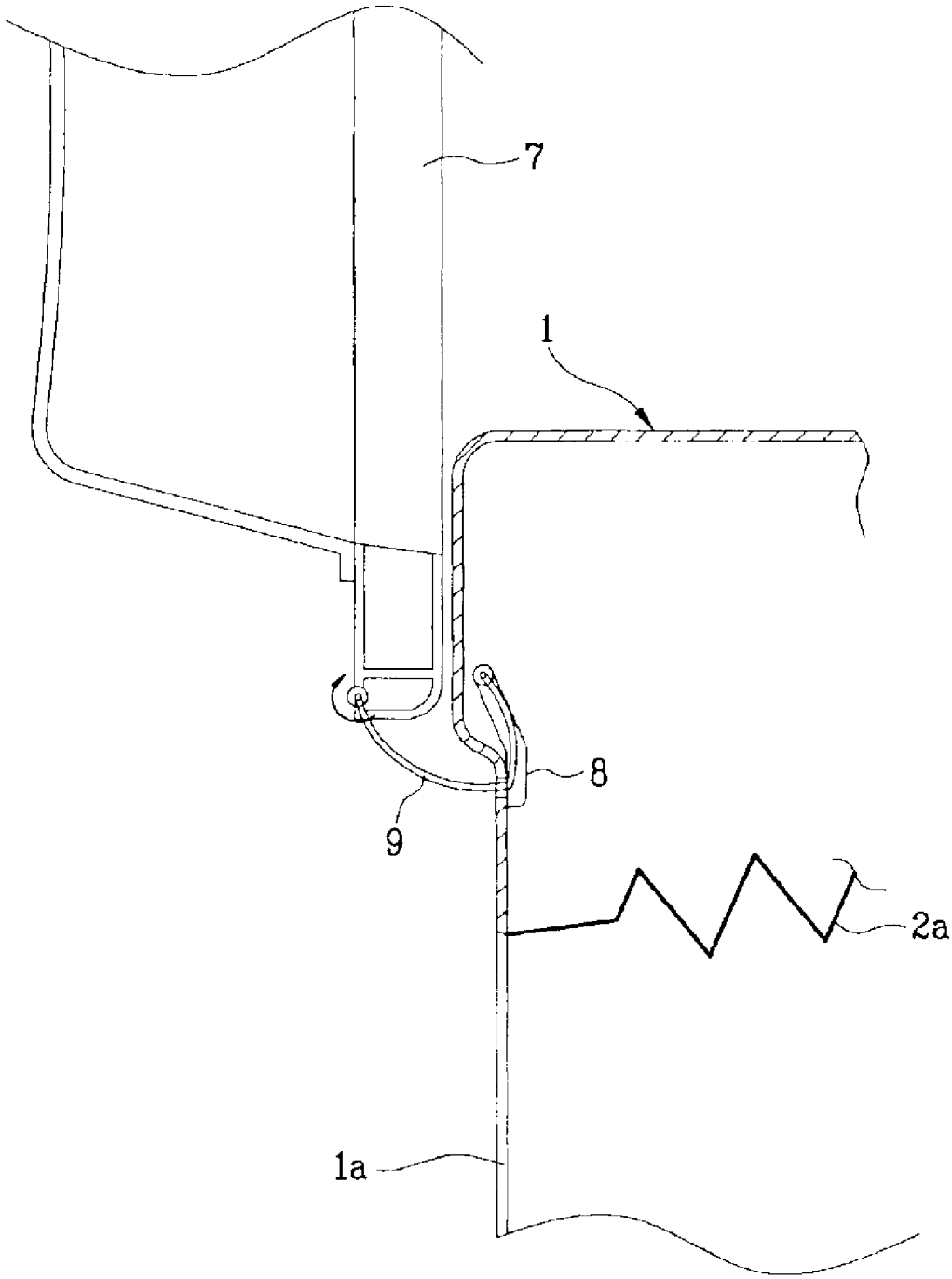
Figure 4:
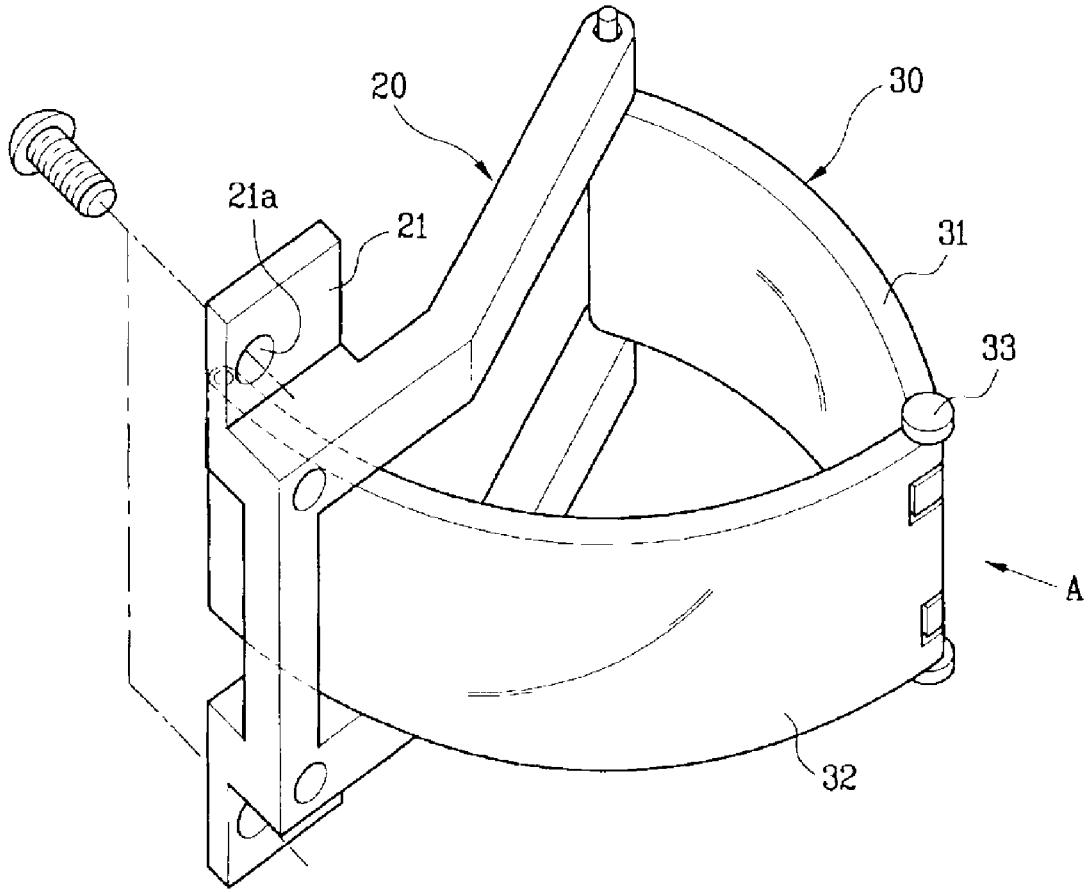
FIG. 4 a perspective view of a device for linking a door to a case in a drum type washing machine in accordance with a preferred embodiment of the present invention.
Figure 5:
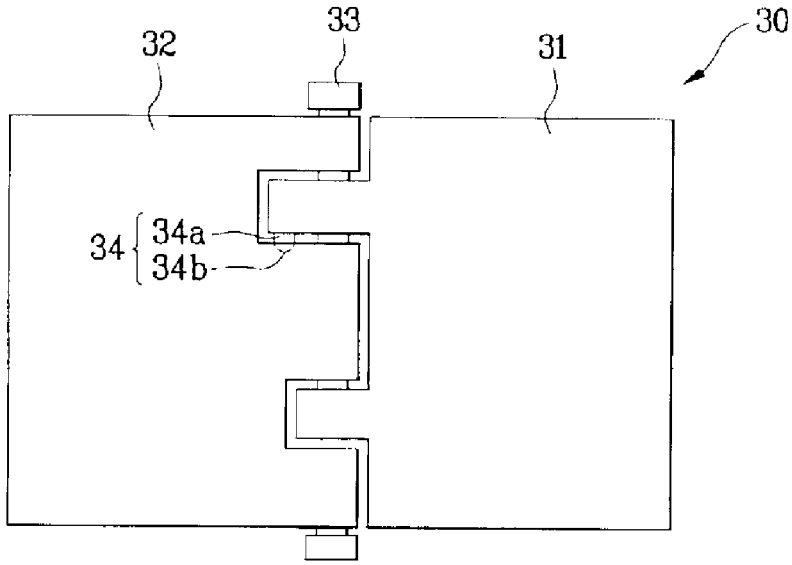
FIG. 5 illustrates a key part of a link member seen from "A" in FIG. 4.

FIG. 4 a perspective view of a device for linking a door to a case in a drum type washing machine in accordance with a preferred embodiment of the present invention, and FIG. 5 illustrates a key part of a link member seen from "A" in FIG. 4. In explanation of the drum type washing machine will be omitted as the same is explained in the related art, and parts identical to the related art will be given the same reference symbol.

Referring to FIG. 4, the device for linking a door to a case in a drum type washing machine includes a bracket 20 fitted to an inside of a case 1, and a link member 30 rotatably supported by the bracket 20 and rotatably coupled with a door 7.

Figure 6:
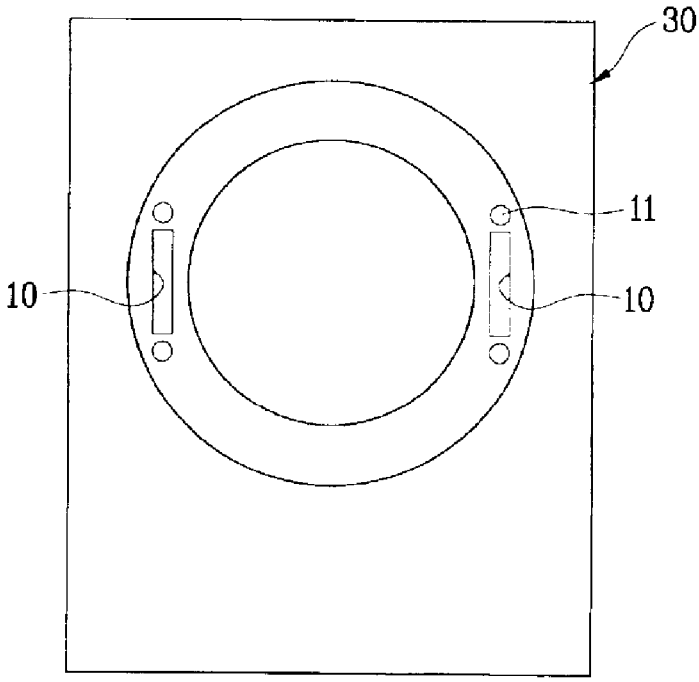
FIG. 6 illustrates a front view showing a front part of a case of the present invention.

In more detail, the bracket 20 includes one end to be inserted in a pass through hole (see 10 in FIG. 6) formed in the vicinity of the laundry opening 1*a* in the case 1, and the other end fixed to an outside wall of the case 1. That is, as shown, the other end, actually fitted to the case 1, is a base part for supporting the link member 30. The one end is two parallel supporting arms spaced a distance apart extended from the base part (i.e., the other end).

The link member 30 includes a first link 31 rotatably fitted to the one end of the bracket 20, a second link 32 exposed to an outside through the pass through hole 10 rotatably fitted to the door 7, and a hinge 33 at movable ends of the first link 31 and the second link 32. One end of the first link 31 is rotatably fitted to the two supporting arms of the bracket 20 (i.e., the other end of the bracket 20) between the two supporting arms. One end of the second link 32 is rotatably fitted to the door 7. Since the first and second links 31 and 32 are connected at the hinge 33, the link member 30 is foldable as required.

Referring to FIG. 5, along with this, it is preferable that a stopper 34 is provided to the hinge 33 of the link member. The stopper 34 facilitates folding of the first link 31 and the second link 32 at a fixed angle. Therefore, when the door is opened/closed after assembly of the case 1 and the door 7 is finished by using the device for linking a door to a case, interference between the second link 32 of the link member and the pass through hole 10 in the case 1 can be prevented.

For this, the stopper 34 includes a projection 34*a* from the first link 31 in the vicinity of the hinge 33, and a recess 34*b* in the second link 32 of the link member. Accordingly, when the link member 30 is folded at an angle, the projection 34*a* is forcibly pressed into the recess 34*b*, to set the first link 31 and the second link 32. Moreover, though not shown, opposite to this, the projection may be formed at the second link 32 side and the recess may be formed in the first link 31 side.

It is preferable that a flange 21 is provided to the other end of the bracket 20 so that the other end of the bracket is caught at the outside wall of the case 1 in assembly, and a stable fastening part to the case is secured. For screw fastening of the flange 21 with the case 1, the flange 21 and the case 1 have fastening holes 21*a*, and 11 in FIG. 6 in communication with each other.

It is preferable that the second link 32 of the link member has an arc form, i.e., a slight curvature, for smooth movement of the second link 32 of the link member through the pass through hole (see 10 in FIG. 7) when the first link of the link member rotates.

Figure 7:
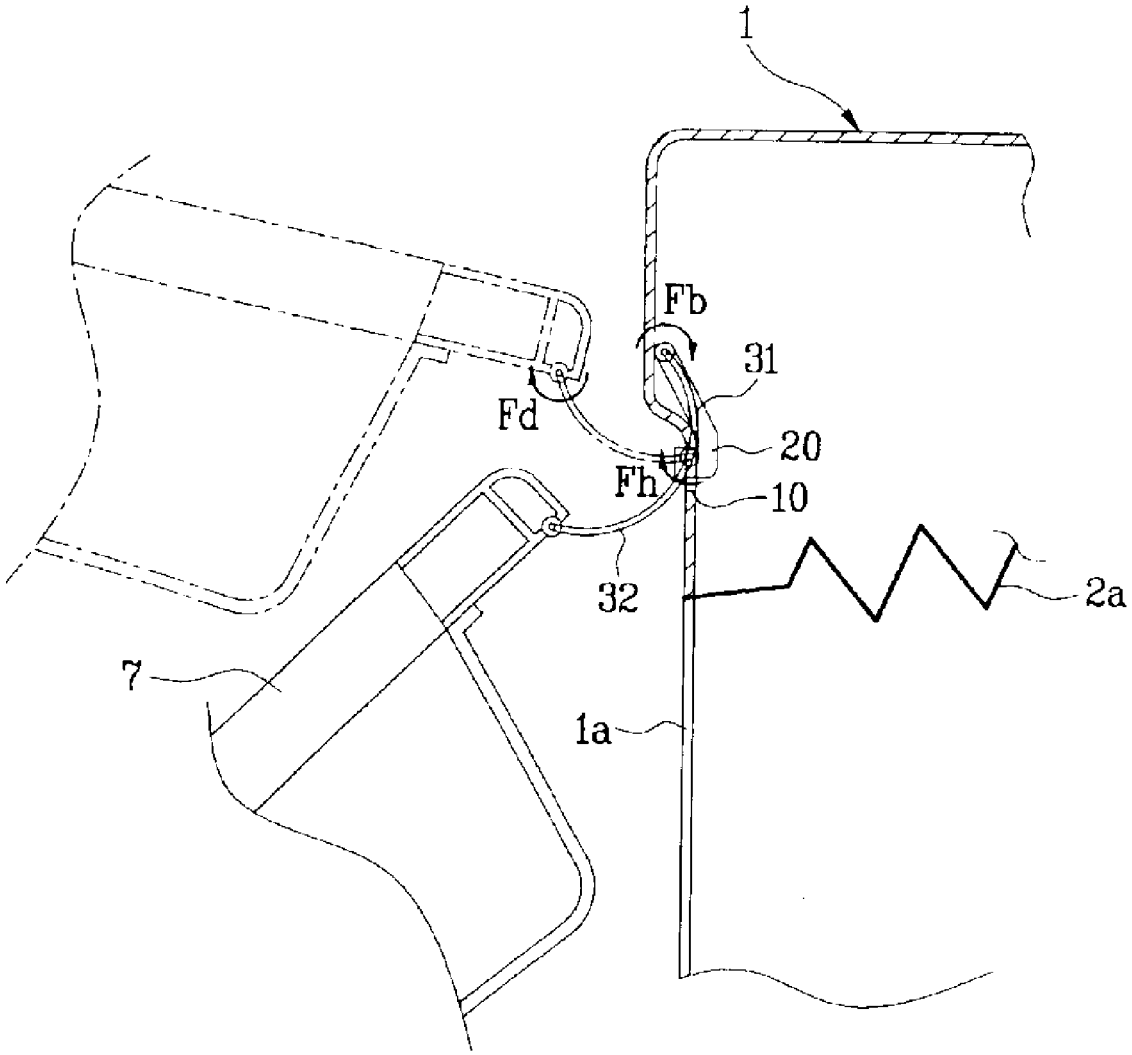
FIG. 7 illustrates a partial enlarged section of a device for linking a door to a case of the present invention after being assembled to a case.

Moreover, referring to FIG. 7, it is preferable that a friction force Fh of the hinge part 33 is greater than a rotating friction force Fb between the first link 31 of the link member 30 and the one end of the bracket 20. It is preferable that the friction force Fh is greater than the rotating friction force Fd between the second link 32 of the link member 30 and the door 7, for prevention of folding/unfolding of the link member 30 at the hinge 33 when the door 7 is opened/closed, to permit a smooth pass of the second link 32 of the link member through the pass through hole 10. Especially, when the stopper 34 is provided to the hinge 33, the friction force Fh of the hinge is inclusive of coupling force between the projection 34*a* of the stopper and the recess 34*b*.

Also, it is preferable that the rotating friction force Fd between the second link 32 of the link member 30 and the door 7 is greater than a rotating friction force Fb between the first link 31 of the link member 30 and the one end of the bracket 20. It is because, if the friction force Fd is smaller than the friction force Fb, smooth rotation of the door 7 together with the link member 30 cab not be made, but only the door is rotated at first, when the assembled door 7 is opened, to cause scratching between the case 1 and the door 7, or fail to open the door smoothly.

Figure 9A:
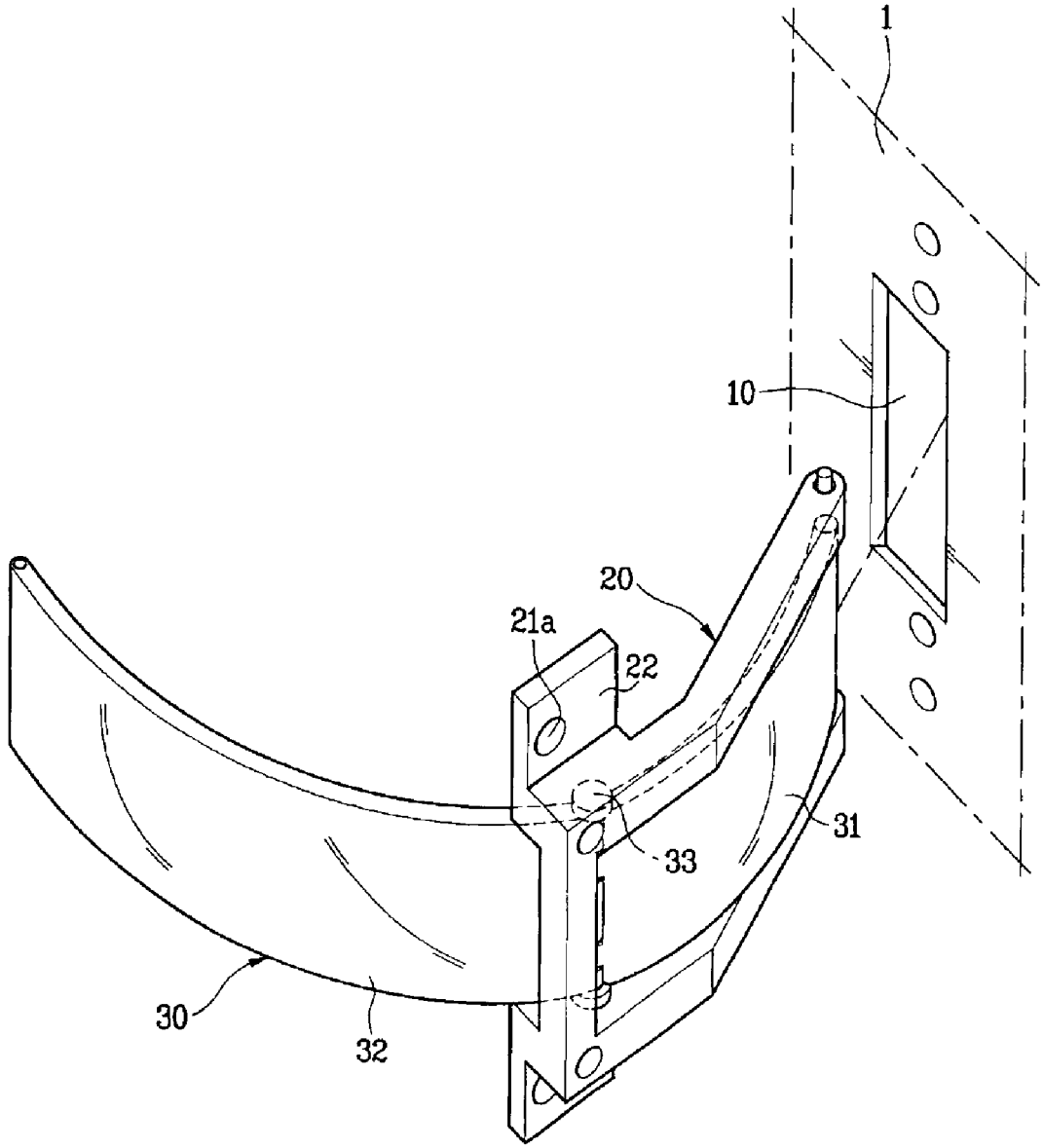
FIGS. 9A–9C illustrate perspective views showing the steps of a process for assembling a device for linking a door to a case in accordance with a preferred embodiment of the present invention.

A method for assembling the foregoing link device in a drum type washing machine of the present invention will be explained in detail, with reference to FIGS. 9A–9C.

At first, the first link 31 of the link member 30 is rotatably fitted to the one end of the bracket 20. That is, as explained, the first link 31 of the link member 30 is rotatably coupled between ends of the two supporting arms of the bracket 20. Then, as shown in FIG. 9A in detail, the first link 31 and the second link 32 of the link member are unfolded fully, and the bracket 20 is rotated until the bracket 20 overlaps with the first link 31 of the unfolded link member 30. That is, the first and second links 31 and 32 are unfolded around the hinge 33, such that the first link 31 is positioned between the supporting arms of the bracket 20. In more detail, a distance between the first and second links 31 and 32 is made the greatest, and the first link 31 is not projected beyond the bracket 20 (in more detail, not beyond the supporting arms).

Figure 9B:
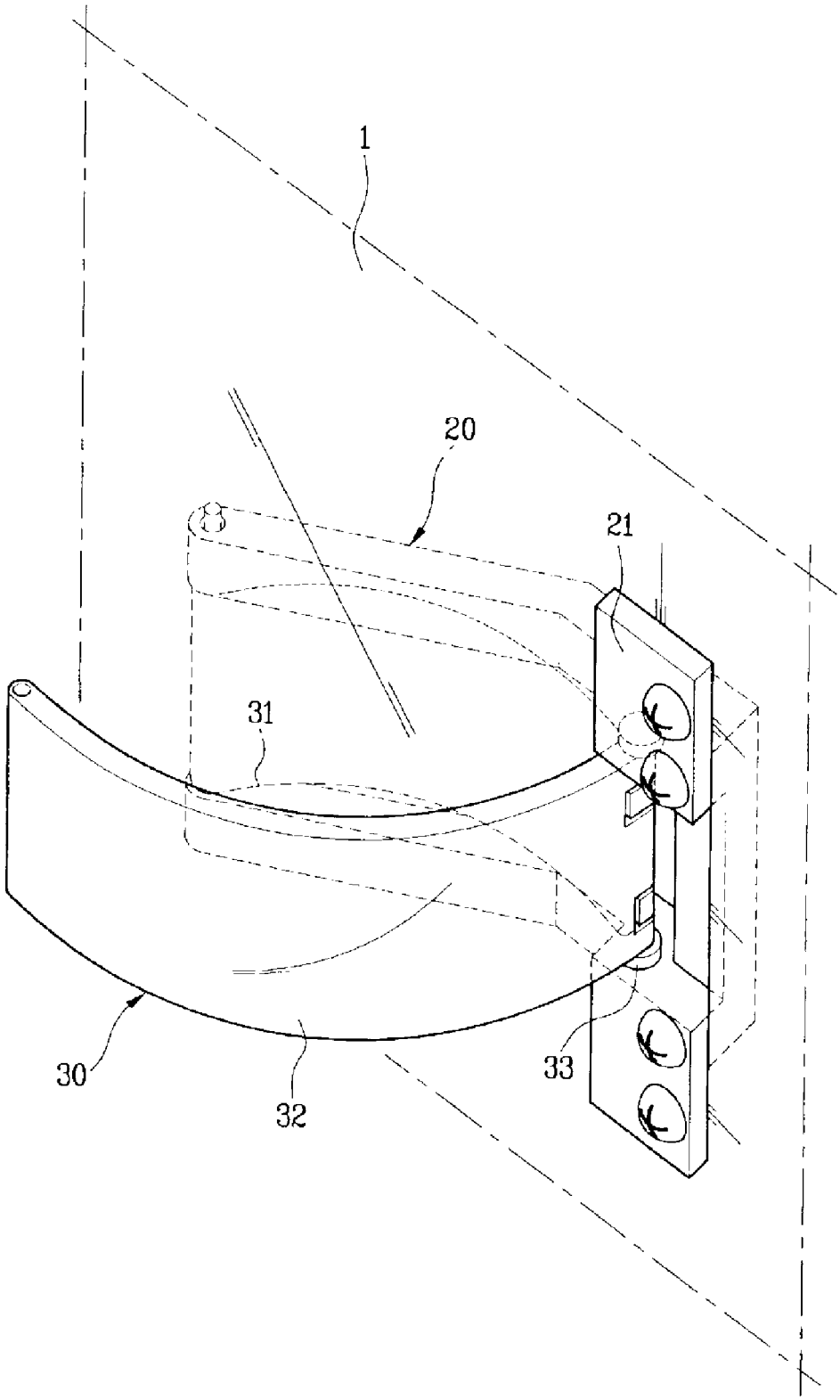

Therefore, as shown in FIG. 9B, the first link 31 of the link member 30 and the one end of the bracket 20 can be inserted through the pass through hole 10 in the case 1. In more detail, the supporting arms of the bracket 20 are inserted smoothly together with the first link 31, without being caught at the pass through hole 10. Then, the flange 21 on the other end of the bracket 20 is fastened to the outside wall of the case 1 with screws.

Figure 9C:
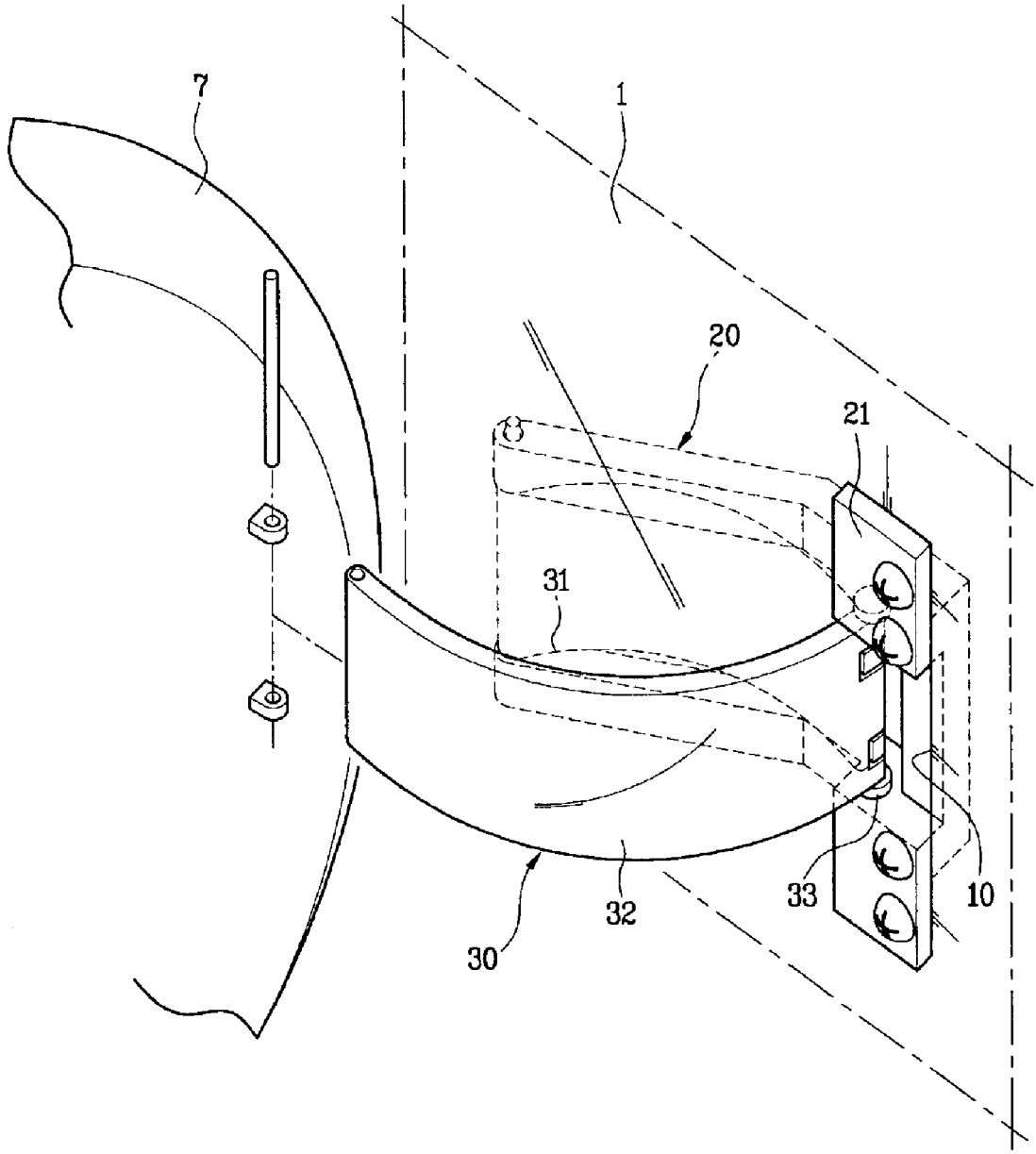

Then, as shown in FIG. 9C, the link member 20 is folded in a rotation direction of the door 7, such that the second link 32 has a rotation radius around the first link 31 of the link member 30. That is, the second link 32 is rotated around the hinge 33 until stopped by the stopper 34 when the first and second links 31 and 32 form an acute angle. Accordingly, the link member 20 is made to have a rotation radius smaller than a rotation radius in an unfolded state, and to rotate smoothly around the end fixed to the bracket 20 without interference with the pass through hole 10 on the whole.

Then, upon rotatably fitting the second link 32 of the link member 30 to the door 7, the assembly is finished.

In the meantime, since the link device is designed such that all assembly of the link device can be made on an outside of the case 1, even if the drum type washing machine is fully fabricated, the fitting position of the link device is changed easily according to a user's specification without detachment of components (particularly, the gasket 2*a*) from the inside of the case 1.

That is, after unfolding the first link 31 and the second link 32 of the link member, unscrewing the screw, and drawing the link member 30 and the bracket 20 out of the case 1, the foregoing assembly method is used as it is in re-fitting the link device to a left, or right side of the laundry opening (see 10 in FIG. 6) to suit to a left handed, or right handed user.

Figure 8A:
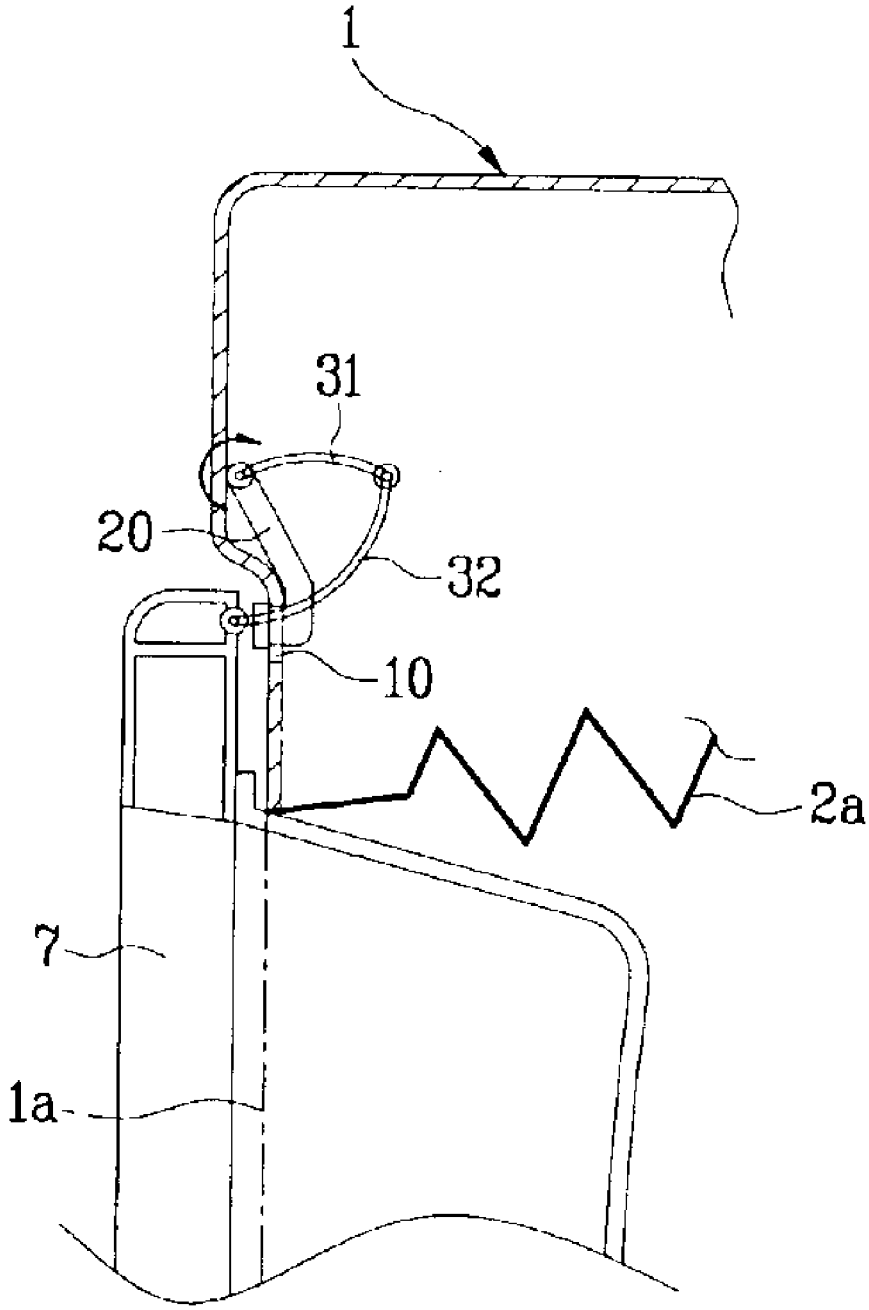
FIGS. 8A and 8B illustrate an opening process of a laundry opening by rotating a door using a link device of the present invention.
Figure 8B:
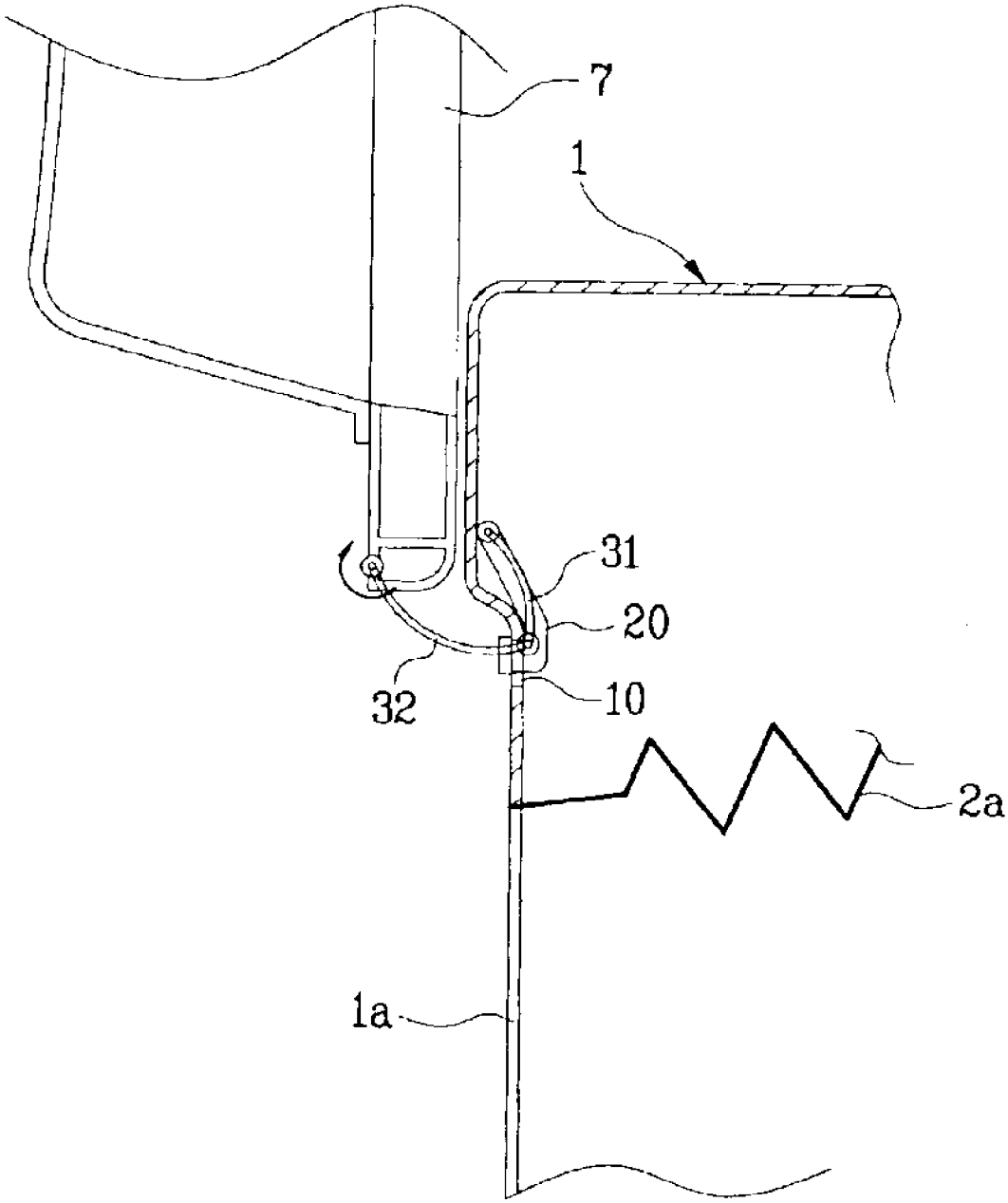

Thus, as shown in FIGS. 8A or 8B, upon finishing the fitting suitable to the user's specification, the laundry opening 1*a* in the case 1 can be closed, or opened as the door 7 is rotated.

As has been explained, the device for linking a door to a case in a drum type washing machine, and the method for assembling the same of the present invention have the following advantages.

First, all the assembly process which can be done perfectly on an outside of the case permits an easy assembly and to reduce an assembly time period.

Second, the easy fitting position change of the link device even after full completion of fabrication of the washing machine according to a left handed or right handed user permits to improve user's convenience as well as user reliability on the washing machine.

It will be apparent to those skilled in the art that various modifications and variations can be made in the device for linking a door to a case in a drum type washing machine, and the method for assembling the same of the present invention without departing from the spirit or scope of the invention. Thus, it is intended that the present invention cover the modifications and variations of this invention provided they come within the scope of the appended claims and their equivalents.

What is claimed is:

1. A device for linking a door to a case in a drum type washing machine comprising:

a bracket including one end to be inserted in a pass through hole formed in the vicinity of the laundry opening in a washing machine case, and the other end fixed to an outside wall of the case; and a foldable link member including a first link rotatably fitted to the one end of the bracket, a second link exposed to an outside through the pass through hole and rotatably fitted to the door, and a hinge connecting the first link and the second link, thereby fitting the link member and the bracket to be detachable from an outside of the washing machine on the same time by inserting the link member in an unfolded state, together with the bracket through the pass through hole.

2. A device for linking a door to a case as claimed in claim 1, wherein the hinge of the link member further includes a stopper.

3. A device for linking a door to a case as claimed in claim 2, wherein the stopper includes;

a projection from the first link of the link member in the vicinity of the hinge, and a recess in the second link of the link member, thereby, when the link member is folded, the projection is inserted in the recess until the first link and the second link are set at an angle.

4. A device for linking a door to a case as claimed in claim 1, further comprising a flange so that the other end of the bracket is caught at the outside wall of the case, and a fastening part to the case is secured.

5. A device for linking a door to a case as claimed in claim 4, wherein, for screw fastening of the flange with the case, the flange and the case have fastening holes in communication to each other.

6. A device for linking a door to a case as claimed in claim 1, wherein the second link of the link member includes an arc form, for smooth movement of the second link of the link member through the pass through hole when the first link of the link member rotates.

7. A device for linking a door to a case as claimed in claim 1, wherein the hinge has a friction force Fh greater than a rotating friction force Fb between the first link of the link member and the one end of the bracket, and greater than a rotating friction force Fd between the second link of the link member and the door.

8. A device for linking a door to a case as claimed in claim 7, wherein the rotating friction force Fd between the second link of the link member and the door is greater than rotating friction force Fb between the first link of the link member and the one end of the bracket.

* * * * *